US009625226B2

(12) United States Patent
Lee et al.

(10) Patent No.: US 9,625,226 B2
(45) Date of Patent: Apr. 18, 2017

(54) MUNITIONS CARRIER AND METHOD OF OPERATING THE SAME

(71) Applicant: Agency For Defense Development, Daejeon (KR)

(72) Inventors: Haesuk Lee, Chungcheongnam-do (KR); Taeho Han, Daejeon (KR); Sungho Park, Seosan-si (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 143 days.

(21) Appl. No.: 14/618,711

(22) Filed: Feb. 10, 2015

(65) Prior Publication Data

US 2016/0265861 A1 Sep. 15, 2016

(30) Foreign Application Priority Data

Jun. 12, 2014 (KR) ..... 10-2014-0071464

(51) Int. Cl.
*F41A 9/09* (2006.01)
*F41A 9/87* (2006.01)

(52) U.S. Cl.
CPC ..... *F41A 9/87* (2013.01)

(58) Field of Classification Search
CPC ..... F41A 9/09; F41A 9/50; F41A 9/16; F41A 9/54; F41A 23/26; F41A 23/28
USPC ..... 89/40.07
See application file for complete search history.

(56) References Cited

U.S. PATENT DOCUMENTS 1,396,598 A * 11/1921 Schneider ..... F41A 23/26 180/238
2,520,118 A * 8/1950 Conlon ..... F41A 23/32 89/40.01
2,549,835 A * 4/1951 McCann ..... F41A 23/36 89/40.11
2,855,828 A * 10/1958 Girouard ..... F41A 9/13 89/21
3,218,930 A * 11/1965 Girouard ..... F41A 9/16 89/45
3,366,009 A * 1/1968 Aldrin ..... F41A 23/28 89/40.11
4,457,209 A * 7/1984 Scheurich ..... F41A 9/14 89/34
4,729,279 A * 3/1988 Collanus ..... B60P 1/64 89/40.13
4,860,633 A * 8/1989 Wiethoff ..... F41A 9/16 89/33.02
5,461,961 A * 10/1995 Baus ..... F41A 23/42 89/1.815

(Continued)

FOREIGN PATENT DOCUMENTS

CN 200941038 Y 8/2007
KR 10-2003-0052495 A 6/2003

(Continued)

*Primary Examiner* — Michael David
(74) *Attorney, Agent, or Firm* — John P. White; Cooper & Dunham LLP

(57) ABSTRACT

A munitions carrier may include a munitions loading table having a loading section loaded with munitions and a roller assembly for moving the munitions, and a munitions transfer unit attached to one side of the munitions loading table so as to be adjacent to the roller assembly, in order to transfer the munitions to a charge section provided in an artillery gun.

12 Claims, 8 Drawing Sheets

(56) References Cited

U.S. PATENT DOCUMENTS

| | | | | |
|---|---|---|---|---|
| 6,024,007 | A * | 2/2000 | Searle | F41A 23/30 89/37.13 |
| 6,457,396 | B1 * | 10/2002 | Bean | F41A 23/34 89/40.01 |
| 6,679,159 | B1 * | 1/2004 | Hullett | F41A 9/07 89/45 |
| 6,742,435 | B2 * | 6/2004 | Staiert | F41A 23/00 89/40.02 |
| 7,140,290 | B2 * | 11/2006 | Borgwarth | F41A 23/26 414/476 |
| 7,878,101 | B2 * | 2/2011 | Heldmann | B63G 3/04 89/1.801 |
| 8,434,397 | B1 * | 5/2013 | Deckard | B64D 7/06 89/37.13 |
| 8,549,981 | B2 * | 10/2013 | Chiappini | F41A 9/21 89/46 |
| 8,578,835 | B2 * | 11/2013 | Chiappini | F41A 9/73 89/45 |
| 2014/0102286 | A1 * | 4/2014 | Dawson | F41A 23/28 89/14.3 |

FOREIGN PATENT DOCUMENTS

| | | |
|---|---|---|
| KR | 10-2005-0089921 | 9/2005 |
| KR | 10-2013-0131689 | 12/2013 |

* cited by examiner

MUNITIONS CARRIER AND METHOD OF OPERATING THE SAME

CROSS-REFERENCE TO RELATED APPLICATIONS

This application claims priority to Korean Patent Application No. 10-2014-0071464, filed on Jun. 12, 2014, which is incorporated herein by reference in its entirety.

TECHNICAL FIELD

Exemplary embodiments of the present invention relate to a munitions carrier and a method of operating the same; and, particularly, to a munitions carrier and a method of operating the same, capable of mechanically loading a charge unit with munitions for a firing test.

BACKGROUND

A firing test for thousands of activated or inactivated munitions each year is executed in the general test center. The inactivated munitions capture 60% or more of munitions used in the firing test and are mainly used for a propellant performance test, a metal part test, etc.

The inactivated munitions tested through an artillery gun have the same weight as actual high explosives since sand, gypsum, stearic acid, etc. are mixed in a munitions body similarly to the activated munitions, and are used in an actual firing test.

When the firing test is executed, field test personnel undergo psychological burdens as well as physical burdens in terms of safety as the field test personnel directly take munitions to load a charge unit the munitions.

For this reason, the field test personnel may typically suffer chronic spondylalgia which is likely to occur due to repeated work or acute spondylalgia which is likely to suddenly occur due to an unstable posture.

In order to resolve difficulties caused during the firing test, there is a need for a device capable of mechanically transferring munitions, instead of transferring the munitions by human effort when the firing test is executed.

SUMMARY

An embodiment of the present invention is directed to a munitions carrier and a method of operating the same, capable of mechanically transferring munitions, instead of transferring the munitions by human effort when a firing test is executed.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a munitions carrier includes a munitions loading table having a loading section loaded with munitions and a roller assembly for moving the munitions, and a munitions transfer unit attached to one side of the munitions loading table so as to be adjacent to the roller assembly, in order to transfer the munitions to a charge section provided in an artillery gun.

A height adjustment cylinder for adjusting a height of the loading section may be provided beneath the munitions loading table. A plurality of wheels for movement of the munitions loading table may be provided beneath the munitions loading table, and a plurality of position fixing and parallel adjustment screws may be provided to fix the munitions loading table.

The munitions transfer unit may include a fixed arm attached to one side of the munitions loading table so as to protrude therefrom, a movable bar that is perpendicular to the fixed arm and is movably mounted to the fixed arm, a rotary link coupled to one side of the movable bar by a hinge so as to be parallel with the fixed arm, and a munitions tray that is parallel with the fixed arm and is coupled to the rotary link by a hinge so as to be erected on the roller assembly. An insertion hole may be formed in a width direction of the fixed arm and the movable bar may be inserted into the insertion hole. The fixed arm may be configured of a plurality of fixed arms, and the plurality of fixed arms may be provided with collection bars for maintaining a distance between the fixed arms while the collection bars is parallel with the movable bar.

A rotation speed adjustment cylinder may be provided between the rotary link and the munitions tray. The munitions loading table may be provided with a stopper for fixing the munitions tray erected on the roller assembly. The munitions tray may include a munitions support coupled to the rotary link by a hinge while coming into contact with the roller assembly, a side portion erected from the munitions support, a movable bar adjustment lever attached to one side of the side portion, and a protrusion protruding through a through-hole formed on the side portion according to operation of a removal lever attached to the side portion.

The rotary link may be provided with a shock relief unit for reducing shock during contact with the munitions tray.

In accordance with another embodiment of the present invention, a method of operating a munitions carrier includes fixing a munitions tray erected on a roller assembly by a stopper provided in a munitions loading table, transferring munitions loaded onto a loading section to the munitions tray through the roller assembly, seating the munitions tray to a rotary link connected to the munitions tray by a hinge while the munitions tray rotates by release of the stopper, moving the munitions tray to the vicinity of a charge section provided in an artillery gun by operation of a movable bar adjustment lever provided to the munitions tray, and transferring the munitions from the munitions tray to the charge section in such a manner that a protrusion provided in the munitions tray protrudes through a though-hole formed on the munitions tray by operation of a removal lever provided in the munitions tray.

The seating the munitions tray to a rotary link may operate a rotation speed adjustment cylinder provided between the rotary link and the munitions tray so as to reduce a rotation speed of the munitions tray after the stopper is released, and may relieve shock by a shock relief unit provided in the rotary link shock when the munitions tray comes into contact with the rotary link. The fixing a munitions tray may operate a position fixing and parallel adjustment screw provided beneath the munitions loading table such that the munitions loading table is parallel with the ground.

DETAILED DESCRIPTION

DESCRIPTION OF SPECIFIC EMBODIMENTS

Figure 1:
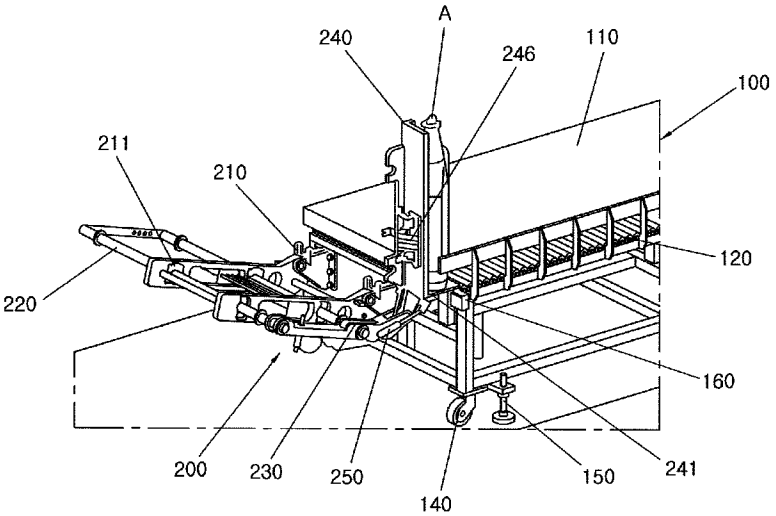
FIG. 1 is a perspective view illustrating a munitions carrier according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

A munitions carrier according to an embodiment of the present invention is an independent device which is not mounted to an artillery gun and may load a charge unit with munitions by one test person for a firing test.

When munitions A erected on a munitions loading table 100 are put on a munitions tray 240 using a roller assembly 120, the munitions tray 240 is laid down through free fall by the same angle as a gun high angle (about 10 degrees).

In this case, a rotation speed adjustment cylinder 250 is installed beneath the munitions tray 240 in order to lay the munitions A down by a certain angle, and a shock relief unit 260 is installed beneath the munitions tray 240 in order to relieve shock when the munitions tray 240 is laid down.

Munitions transfer is completed when a removal lever 244 is raised after movement of the munitions A to the side of a charge section R of the artillery gun and the munitions A on the munitions tray 240 are transferred onto the charge section R provided in the artillery gun.

When the munitions transfer is completed, the munitions tray 240 is returned to an initial position. Thus, one cycle is completed.

In the embodiment, position fixing and parallel adjustment screws 150 are installed to the side of the table in order to prevent collision caused between a gun breech and the munitions tray 240 by recoil motion arising from movement of the munitions tray 240 to a gun breech unit due to explosion pressure generated during firing and in order to enhance safety.

Hereinafter, an operation of the munitions carrier will be shortly described. The munitions A transferred from the roller assembly 120 come into contact with the munitions tray 240 and then laid down by the same angle as the gun high angle (about 10 degrees). In this case, since the rotation speed adjustment cylinder 250 is installed beneath the munitions tray 240 as described above, the munitions tray 240 is controlled at a proper speed.

The shock relief unit 260 is used to relieve shock due to the weights of the munitions A and munitions tray 240.

Fixed arms 210 and movable bars 220 are provided in a munitions transfer section 200 in order to move the munitions A to the side of the charge section R.

The movable bars 220 are preferably designed in due consideration of a problem in which the movable bars 220 may be deflected by the weights of the munitions A during transfer thereof.

A protrusion 246 and the removal lever 244 are used in a manner of transferring the munitions to the charge section R provided in the artillery gun.

The munitions A are laid down on a side portion 242 on the munitions tray 240, and the protrusion 246 protrudes through a through-hole 245 formed on the side portion 242 when the removal lever 244 operates so that the munitions A are separated from the side portion 242.

Hereinafter, an embodiment of the present invention will be described in detail with reference to the accompanying drawings. The present invention may be embodied in different forms and should not be construed as limited to the embodiments set forth herein.

Figure 2:
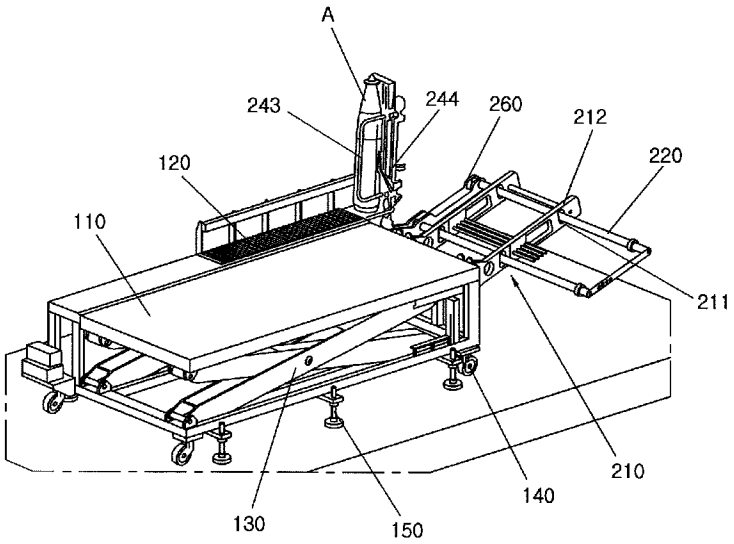
FIG. 2 is another perspective view illustrating the munitions carrier in FIG. 1.
Figure 3:
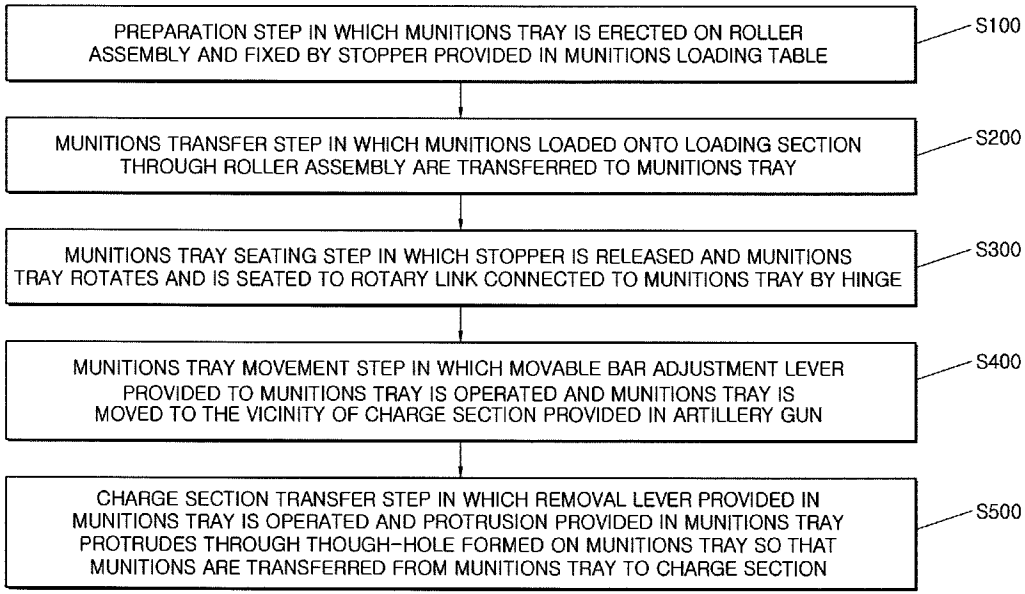
FIG. 3 is a flowchart illustrating a method of operating a munitions carrier according to an embodiment of the present invention.
Figure 4:
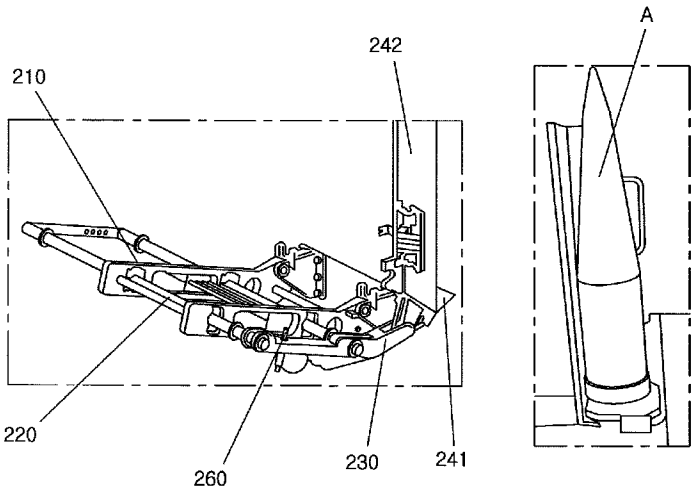
FIG. 4 is a view illustrating a state of a munitions transfer step in the method of operating a munitions carrier in FIG. 3.

As shown in FIGS. 1 and 2, a munitions carrier according to the embodiment of the present invention includes a munitions loading table 100 which is provided with a loading section 110 loaded with munitions A and a roller assembly 120 for moving the munitions, and a munitions transfer section 200 which is attached to one side of the munitions loading table 100 so as to be adjacent to the roller assembly 120 for transferring the munitions A to a charge section provided in an artillery gun.

A height adjustment cylinder 130 for adjusting a height of the loading section 110 is provided beneath the munitions loading table 100, a plurality of wheels 140 for movement of the munitions loading table 100 is provided beneath the munitions loading table 100, and a plurality of position fixing and parallel adjustment screws 150 for fixing the munitions loading table 100 is provided beneath the munitions loading table 100.

The munitions transfer section 200 includes fixed arms 210 attached to one side of the munitions loading table 100 so as to protrude therefrom, movable bars 220 which are perpendicular to the fixed arms 210 and are movably mounted to the fixed arms 210, a rotary link 230 which is parallel with the fixed arms 210 and is coupled to one side of the movable bars 220 by a hinge, and a munitions tray 240 which is parallel with the fixed arms 210 and is coupled to the rotary link 230 by a hinge so as to be erected on the roller assembly 120.

Insertion holes 211 are formed in a width direction of the fixed arms 210 and the movable bars 220 are inserted into the insertion holes 211.

In the embodiment of the present invention, two fixed arms 210 are provided in parallel with each other and each has the same angle as the charge section provided in the artillery gun.

Two movable bars 220 are provided in parallel with each other and the rotary link 230 is coupled to one side of the movable bars 220. The rotary link 230 includes a body portion attached to the parallel movable bars 220 and a rotation portion, both ends of which are respectively coupled to the body portion and the munitions tray 240 by hinges.

The plurality of fixed arms 210 is provided with collection bars 212 for maintaining a distance between the fixed arms 210 while the collection bars 212 are parallel with the movable bars 220.

A rotation speed adjustment cylinder 250 is provided between the rotary link 230 and the munitions tray 240 and the rotation speed of the munitions tray 240 is adjusted by the rotation speed adjustment cylinder 250.

The munitions loading table 100 is provided with a stopper 160 for fixing the munitions tray 240 erected on the roller assembly 120.

The munitions tray 240 includes a munitions support 241 which comes into contact with the roller assembly 120 and is coupled to the rotary link 230 by a hinge, a side portion 242 erected from the munitions support 241, a movable bar adjustment lever 243 attached to one side of the side portion 242, and a protrusion 246 which protrudes through a through-hole 245 formed on the side portion 242 according to operation of a removal lever 244 attached to the side portion 242.

The rotary link 230 is provided with a shock relief unit 260 for reducing shock during contact with the munitions tray 240. In the embodiment of the present invention, the shock relief unit 260 is provided in the body portion constituting the rotary link 230.

As shown in FIGS. 3 to 8, a method of operating a munitions carrier according to the embodiment of the present invention includes a preparation step S100 in which the munitions tray 240 is erected on the roller assembly 120 and fixed by the stopper 160 provided in the munitions loading table 100, a munitions transfer step S200 in which the munitions A loaded onto the loading section 110 through the roller assembly 120 are transferred to the munitions tray 240, a munitions tray seating step S300 in which the stopper 160 is released and the munitions tray 240 rotates and is seated to the rotary link 230 connected to the munitions tray 240 by the hinge, a munitions tray movement step S400 in which the movable bar adjustment lever 243 provided to the munitions tray 240 is operated and the munitions tray 240 is moved to the vicinity of the charge section provided in the artillery gun, and a charge section transfer step S500 in which the removal lever 244 provided in the munitions tray 240 is operated and the protrusion 246 provided in the munitions tray 240 protrudes through the though-hole 245 formed on the munitions tray 240 so that the munitions A are transferred from the munitions tray 240 to the charge section.

After the stopper 160 is released, the rotation speed adjustment cylinder 250 provided between the rotary link 230 and the munitions tray 240 is operated so as to reduce the rotation speed of the munitions tray 240. The shock relief unit 260 provided in the rotary link 230 relieves shock when the munitions tray 240 comes into contact with the rotary link 230.

In the preparation step S100, the position fixing and parallel adjustment screws 150 provided beneath the munitions loading table 100 are operated such that the munitions loading table 100 is parallel with the ground.

In the munitions transfer step S200, the munitions A stored in the munitions loading table 100 are transferred to the munitions tray 240 through the roller assembly 120. In this case, the munitions tray 240 is fixed in a state of being erected on the roll assembly 120 by the stopper 160 provided in the munitions loading table 100.

In the munitions tray seating step S300, the stopper 160 is released and the rotary link 230 rotates about the hinge so that the munitions tray 240 overlaps the movable bars 220. More exactly, the munitions tray 240 is laid down on the body portion constituting the rotary link 230.

In this case, the rotation speeds of the munitions tray 240 and the rotary link 230 are adjusted by the operation of the rotation speed adjustment cylinder 250 and the shock between the munitions tray 240 and the body portion is minimized by the shock relief unit 260.

Figure 5:
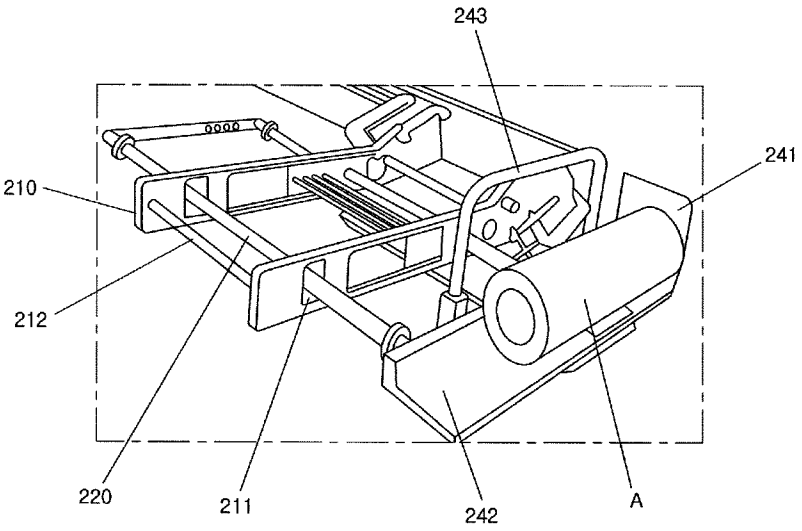
FIG. 5 is a view illustrating a state of a munitions tray movement step in the method of operating a munitions carrier in FIG. 3.
Figure 6:
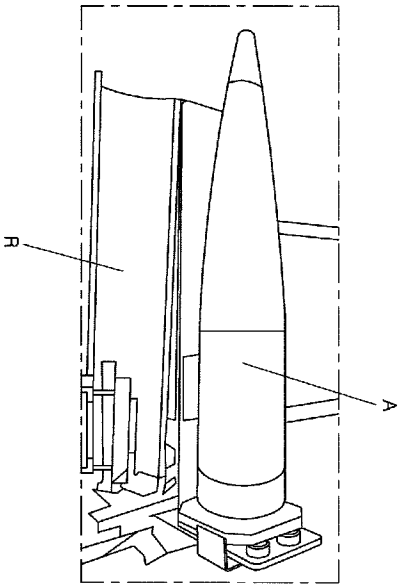
FIG. 6 is a view illustrating a state in which a munitions tray is adjacent to a charge section according to the method of operating a munitions carrier in FIG. 3.
Figure 8:
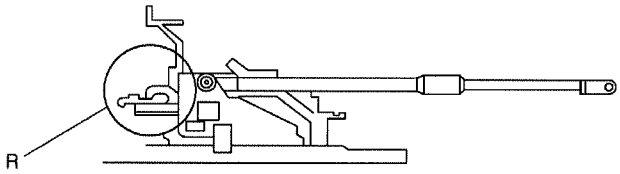
FIG. 8 is an exemplary view illustrating a charge section of an artillery gun.

In the munitions tray movement step S400, the munitions tray 240 is located in the vicinity of the charge section provided in the artillery gun by operating the movable bar adjustment lever 243 provided in the munitions tray 240 (see FIGS. 5, 6, and 8).

Figure 7:
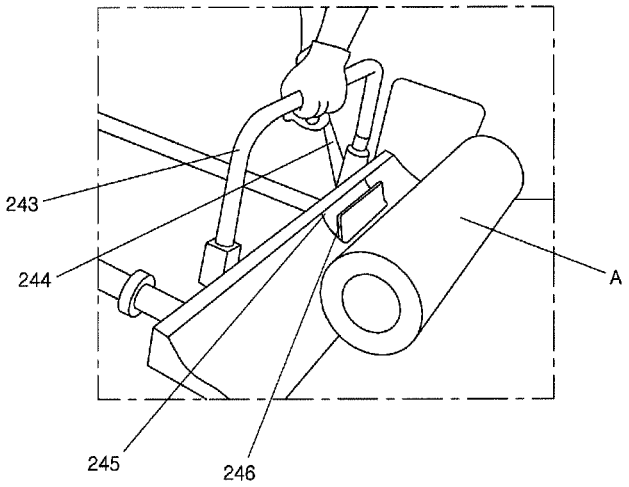
FIG. 7 is a view illustrating a state of a charge section transfer step in the method of operating a munitions carrier in FIG. 3.

In the charge section transfer step S500, the munitions A are pushed and roll to the charge section by operating the protrusion 246 such that the protrusion 246 provided in the munitions tray 240 passes through the through-hole 245 and protrudes through the operation of the removal lever 244 (see FIG. 7).

In accordance with the exemplary embodiments of the present invention, a munitions carrier and a method of operating the same may mechanically transfer munitions to an artillery charge unit.

In addition, it may be possible to significantly resolve physical difficulties of munitions handling personnel.

In addition, it may be possible to enhance safety when munitions are charged.

In addition, it may be possible to improve economic feasibility, safety, effectiveness when a munitions firing test is executed.

While the present invention has been described with respect to the specific embodiments, it will be apparent to those skilled in the art that various changes and modifications may be made without departing from the spirit and scope of the invention as defined in the following claims.

What is claimed is:

1. A munitions carrier comprising:

a munitions loading table having a loading section loaded with the munitions and a roller assembly for moving the munitions; and a munitions transfer unit attached to one side of the munitions loading table so as to be adjacent to the roller assembly, in order to transfer the munitions to a charge section provided in an artillery gun, wherein the munitions transfer unit comprises:

a fixed arm attached to one side of the munitions loading table so as to protrude therefrom;

a movable bar that is perpendicular to the fixed arm and is movably mounted to the fixed arm;

a rotary link coupled to one side of the movable bar by a hinge so as to be parallel with the fixed arm; and a munitions tray that is parallel with the fixed arm and is coupled to the rotary link by a hinge so as to be erected on the roller assembly.

2. The munitions carrier of claim 1, wherein a height adjustment cylinder for adjusting a height of the loading section is provided beneath the munitions loading table.

3. The munitions carrier of claim 1, wherein:

a plurality of wheels for movement of the munitions loading table is provided beneath the munitions loading table; and a plurality of position fixing and parallel adjustment screws are provided to fix the munitions loading table.

4. The munitions carrier of claim 1, wherein an insertion hole is formed in a width direction of the fixed arm and the movable bar is inserted into the insertion hole.

5. The munitions carrier of claim 1, wherein:

the fixed arm is configured of a plurality of fixed arms; and the plurality of fixed arms is provided with collection bars for maintaining a distance between the fixed arms while the collection bars is parallel with the movable bar.

6. The munitions carrier of claim 1, wherein a rotation speed adjustment cylinder is provided between the rotary link and the munitions tray.

7. The munitions carrier of claim 1, wherein the munitions loading table is provided with a stopper for fixing the munitions tray erected on the roller assembly.

8. The munitions carrier of claim 1, wherein the munitions tray comprises:

a munitions support coupled to the rotary link by a hinge while coming into contact with the roller assembly;

a side portion erected from the munitions support;

a movable bar adjustment lever attached to one side of the side portion; and a protrusion protruding through a through-hole formed on the side portion according to operation of a removal lever attached to the side portion.

9. The munitions carrier of claim 1, wherein the rotary link is provided with a shock relief unit for reducing shock during contact with the munitions tray.

10. A method of operating a munitions carrier, comprising:

fixing a munitions tray erected on a roller assembly by a stopper provided in a munitions loading table having a fixed arm attached to one side of the table wherein a movable bar that is perpendicular to the fixed arm is movably mounted to the fixed arm as a movable bar adjustment lever;

transferring munitions loaded onto a loading section to the munitions tray through the roller assembly;

seating the munitions tray to a rotary link coupled to one side of the movable bar by a hinge so as to be parallel with the fixed arm while the munitions tray rotates by release of the stopper;

moving the munitions tray to the vicinity of a charge section provided in an artillery gun by operation of the movable bar adjustment lever provided to the munitions tray; and transferring the munitions from the munitions tray to the charge section in such a manner that a protrusion provided in the munitions tray protrudes through a though-hole formed on the munitions tray by operation of a removal lever provided in the munitions tray.

11. The method of claim 10, wherein the seating the munitions tray to a rotary link operates a rotation speed adjustment cylinder provided between the rotary link and the munitions tray so as to reduce a rotation speed of the munitions tray after the stopper is released, and relieves shock by a shock relief unit provided in the rotary link when the munitions tray comes into contact with the rotary link.

12. The method of claim 10, wherein the fixing a munitions tray operates a position fixing and parallel adjustment screw provided beneath the munitions loading table such that the munitions loading table is parallel with the ground.

* * * * *